United States Patent [19]

Farr

[11] 4,208,053

[45] Jun. 17, 1980

[54] SIMULATED GOLF BALL

[76] Inventor: Eric Farr, Witchhill, Newburgh, Aberdeenshire AB4 OBL, Scotland

[21] Appl. No.: 920,790

[22] Filed: Jun. 30, 1978

[51] Int. Cl.[2] ..... A63B 69/36

[52] U.S. Cl. ..... 273/199 R; 273/58 H; 273/58 F; 273/187 A

[58] Field of Search ..... 273/183 C, 199 R, 199 A, 273/58 F, 58 H, 187 A

[56] References Cited

U.S. PATENT DOCUMENTS

| | | | |
|---|---|---|---|
| 1,464,314 | 8/1923 | Gates | 273/58 F |
| 3,099,452 | 7/1963 | Fernicola | 273/199 R |
| 3,868,109 | 2/1975 | Fowler | 273/187 A |

FOREIGN PATENT DOCUMENTS

| | | | |
|---|---|---|---|
| 684827 | 12/1952 | United Kingdom | 273/199 R |
| 904785 | 8/1962 | United Kingdom | 273/183 C |

*Primary Examiner*—George J. Marlo

*Attorney, Agent, or Firm*—Finnegan, Henderson, Farabow, Garrett & Dunner

[57] ABSTRACT

Apparatus for use in practising golf shots includes a container which can be filled partly or fully with sand or water so as to give it weight. The container is rectangular and one end face has a domed portion which represents a golf ball. A specially strengthened golf club is provided with which the user can practise golf shots. When the container is struck it will move forward a short distance and charts can be provided to equate that movement with an actual golf shot.

3 Claims, 4 Drawing Figures

SIMULATED GOLF BALL

This invention relates to apparatus for use in practising golf shots.

According to the present invention there is provided apparatus for use in practising golf shots comprising a simulated golf ball in the form of a container of resilient material adapted to be filled partly or fully with granular material or liquid and having on a face thereof a domed portion representing the portion of a golf ball to be struck.

Preferably, the container is oblong with the domed golf ball portion on one minor face thereof, and a pluggable opening in another face for filling with or emptying of granulated material or liquid.

Prferably also, the apparatus includes a mat from which the apparatus is hit, said mat having markings thereon to facilitate correct positioning of the ball club head and feet at the "address" position of the user.

Preferably also, the apparatus includes at least one simulated golf club having a reinforced shaft.

An embodiment of the present invention will now be described, by way of example, with reference to the accompanying drawings, in which.

Figure 1:
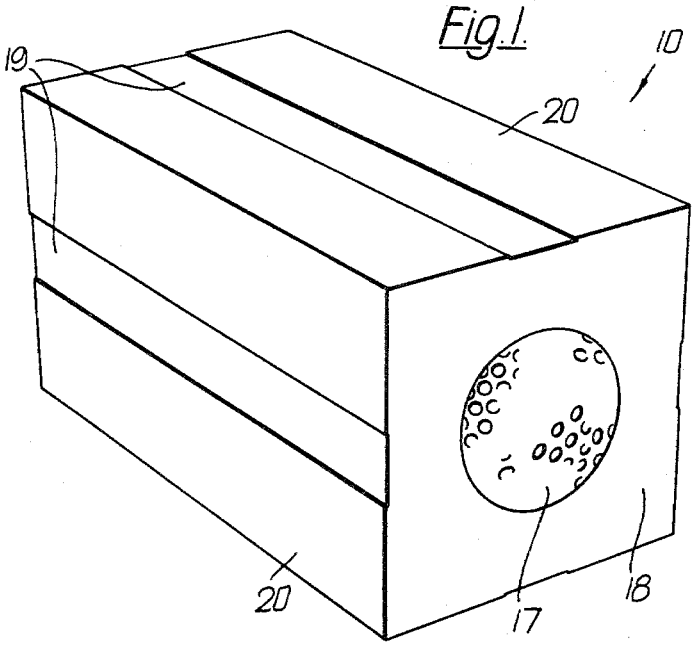
FIG. 1 is a perspective view of a container according to the present invention.

Referring to the drawings, the apparatus for use in practising golf shots includes a simulated golf ball in the form of a hollow container 10, an aligning mat 11 and at least one simulated golf club 12.

The container is constructed of rubber, PVC, nylon or other suitable resilient material. It is oblong in the present embodiment but may be spherical or oval. It is provided with a plugged opening 13 which, in the embodiment, is in one of the end faces 14 and comprises an opening 15 in that face and a plug 16 adapted to be screwed into or out of the opening 15.

Figure 2:
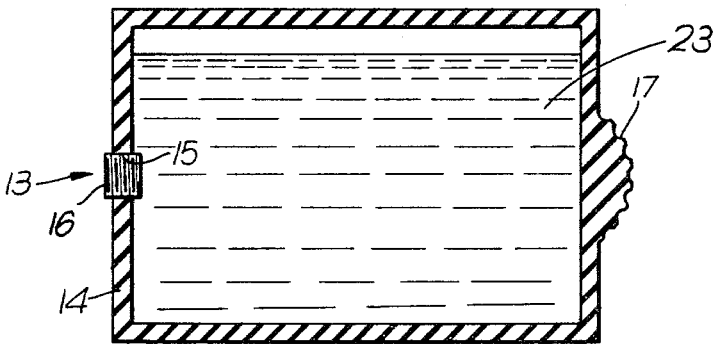
FIG. 2 is a sectional elevation of the container.
Figure 3:
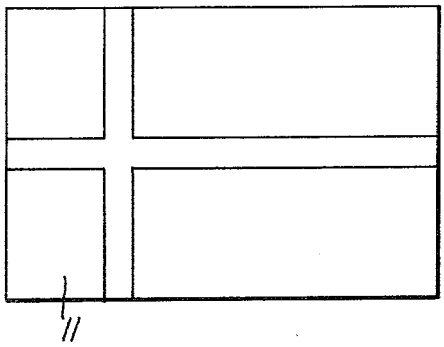
FIG. 3 is a plan view of a mat according to the present invention.
Figure 4:
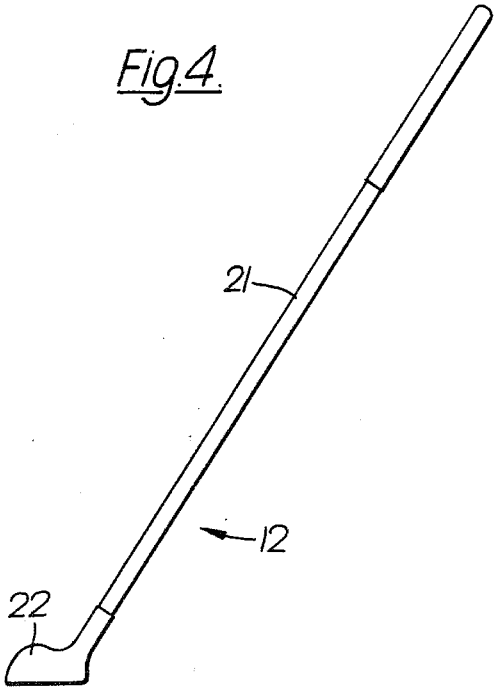
FIG. 4 is an elevation of a simulated golf club.

The container is weighted with granulated material such as sand, soil or water in measured quantities as hereinafter described. The container 14 is shown in FIG. 2 as containing a liquid such as water 23.

A domed portion 17 representing a golf ball is provided in the other end face 18 of the container and comprises the whole or part of a small rubber ball moulded into the container and marked to give the appearance of a golf ball.

The container may be provided with markings, lines or other details 19 incorporated in its top and side faces 20, to assist in indicating the direction of the shot.

The aligning mat is an oblong mat having cross-shaped markings. These are designed to facilitate correct positioning of the ball, clubhead and feet at address. It will also aid in alignment of the shoulders head and hands and other details relating to the swing path of the club. It will also act as an essential reference point for measuring the striking power and accuracy of the stroke played.

The simulated club 12 is a driver of conventional design but with a shaft 21 which is reinforced relative to a normal club; the shaft may be formed of nylon or other plastics material, fibreglass, steel or rubber, the essential feature being its ability to withstand the force of striking the loaded container. The head 22 is made of, for example, plastics material fibre-glass, wood or rubber joined to the shaft by adhesive such as "arldite" or of wood.

The container is weighted to suit the user; for example, for the average golfer, 1500 grammes, for strong wristed golfers 1800 grammes and for ladies 1200 grammes. When loaded ready for use the container can have a total weight in the range 0.7 Kg to 5 Kg, but usually it will be in the range 1 to 2 Kg.

The container, when empty may weigh 0.65 Kg.

In this embodiment, the container is intended for use in practising teeshots; thus, the 'ball' is located above the lower edge of the container so as to be e.g. 50 mm above the surface of the ground or mat when the container is placed thereon.

Other simulated clubs may be provided ranging from "woods" to "irons". All are made with a reinforced shaft of equivalent length. The heads of the "woods" are of similar construction to that of the driver described above and the heads of the "irons" may have a shape corresponding to a normal iron and be made of for example metal (steel), plastics, fibre-glass, wood or rubber; however, the heads of the "irons" may be similar to those of the "woods".

In use, the container 10 is placed on the mat 11 and the user addresses the "ball" part 17 of the container and plays his shot in a manner consistent with a recognisable and reasonably efficient golf stroke; in doing so the following requirements are met:

(a) at impact, the sensation will be similar to that of a normal golf stroke;

(b) the container will be displaced along the ground after impact through a distance of 0.2–15.0 meters (depending on the force of the stroke and the size shape and weight of the container); For example, a professional would hit a 1.3 Kg container a distance of 3 to 14 meters and a heavier container correspondingly less. If the container is hit too far more sand can be added; if it feels too heavy, some sand can be removed. If the user does not wish to walk the 6 to 10 meters to retrieve it after each stroke, he can stand 2 meters from a wall and let the wall stop it, though of course, in such a case the distance of the shot cannot be measured.

(c) displacement of the container after impact will allow for a normal and complete follow through of the club.

The apparatus may be used indoors or out-of-doors, on a floor or carpet, on grass or on concrete or on a beach. When the stroke is played the container is impelled forward and its distance and angle relative to the straight line of the mat can be measured and equated with tabulated information corresponding to an equivalent shot played with a standard club and golf ball; this information will be given in a booklet to be provided with the apparatus.

It is intended to produce the apparatus in the form of a kit comprising (1) a container simulating a golf ball, (2) an aligning mat, (3) an instruction booklet, (4) one or more simulated golf clubs.

While it is possible to use a standard golf club, the simulated club should form part of the kit for two good reasons:

(1) it is stronger than a conventional club having a reinforced shaft (giving impact resistance) and a less damaging head which does not have a steel sole plate (2) most people would not wish to use a normal club for striking the container (because of the damage it would cause to a normal club).

In addition, guidance and figures published in the booklet will relate to and can be compared directly with performances on a "standard" club.

The simulated club is not designed for hitting golf balls. Details of suitable simulated clubs are as follows:

| | Length (cm) | | | Weight (g) | | | Distance of Center of Gravity from Grip-End of Club. | | |
|---|---|---|---|---|---|---|---|---|---|
| | Max. | Min. | Preferred | Max | Min. | Preferred | Max. | Min. | Preferred |
| Wooden Club | 130 | 105 | 114 | 440 | 320 | 380 | 84 | 70 | 78 |
| Iron Club | 105 | 90 | 96 | 500 | 400 | 450 | 80 | 60 | 70 |

The booklet will discuss important factors relating to swing technique, golf practice and other aspects of golf coaching. It will illustrate and describe clearly the important features of a sound swing and the application of the apparatus hereinbefore described in achieving individual improvement.

The mat provides not only guide lines to help the user find the correct stance and alignment, but protects the clubhead and the ground or floor from damage and gives a reference point from which the distance covered by the hit container of a given weight. The amount of slice or hook (if any) cannot be measured accurately but the "feel" of the stroke and the displacement from the central line are indications of the accuracy obtained.

What I claim is:

1. Apparatus for use in practising golf shots comprising a hollow rectangular container having six generally flat sides and weighing 0.65 Kg. when empty, said container having a pair of minor faces at opposite ends, an opening in one minor face of said container, closure means removable disposed in said opening, means weighting said container for use during practice of golf shots including granular or liquid material located in said container, said weighted container weighing from 0.7 Kg. to 5.0 Kg., said container having a centrally located domed portion on the other minor face thereof simulating a golf ball.

2. Apparatus as claimed in claim 1 which includes a mat from which the apparatus hits, said mat having markings thereon to facilitate correct positioning of the ball, clubhead and feet at "address" position of the user.

3. Apparatus as claimed in claim 1 or claim 2 which further includes a simulated golf club having a shaft which is reinforced to a strength greater than a normal golf club shaft.

* * * * *